US008698698B2

(12) United States Patent
Togashi

(10) Patent No.: US 8,698,698 B2
(45) Date of Patent: Apr. 15, 2014

(54) PORTABLE ELECTRONIC DEVICE

(75) Inventor: Daisuke Togashi, Kanagawa (JP)

(73) Assignee: Kyocera Corporation, Kyoto (JP)

( * ) Notice: Subject to any disclaimer, the term of this patent is extended or adjusted under 35 U.S.C. 154(b) by 475 days.

(21) Appl. No.: 13/030,530

(22) Filed: Feb. 18, 2011

(65) Prior Publication Data

US 2011/0199283 A1 Aug. 18, 2011

(30) Foreign Application Priority Data

Feb. 18, 2010 (JP) ..... 2010-033887

(51) Int. Cl.
*H01Q 1/00* (2006.01)
*H01Q 1/52* (2006.01)

(52) U.S. Cl.
USPC ..... 343/904; 343/851

(58) Field of Classification Search
USPC ..... 343/904, 700 MS
See application file for complete search history.

(56) References Cited

U.S. PATENT DOCUMENTS

2006/0192714 A1* 8/2006 Koyama et al. ..... 343/702
2009/0115668 A1* 5/2009 Abe ..... 343/702
2009/0196371 A1* 8/2009 Yamamoto et al. ..... 375/267

FOREIGN PATENT DOCUMENTS

EP 2182705 A1 * 5/2010 ..... H01Q 3/24
JP 2009-44224 A 2/2009
WO WO 2009/051211 * 4/2009 ..... H01Q 3/24

* cited by examiner

*Primary Examiner* — Dameon Levi
*Assistant Examiner* — Ricardo Magallanes
(74) *Attorney, Agent, or Firm* — Hoffmann & Baron, LLP

(57) ABSTRACT

A portable electronic device is provided that is capable of reducing the degradation in the characteristic of an antenna caused by the orientation direction of the antenna being fixed. The device includes a circuit board disposed in the vicinity of an antenna, a conductive switch terminal that is provided to the circuit board and detects an operation to an operation unit, a reference potential part provided to the circuit board to be opposite to the switch terminal, a conductive part provided to the circuit board to be opposite to the antenna, and a switch unit capable of switching whether the reference potential part and the conductive part are electrically connected.

7 Claims, 14 Drawing Sheets

PORTABLE ELECTRONIC DEVICE

This application is based on and claims the benefit of priority from Japanese Patent Application No. 2010-033887, filed on 18 Feb. 2010, the content of which is incorporated herein by reference.

BACKGROUND OF THE INVENTION

1. Field of the Invention

The present invention relates to a portable electronic device equipped with an antenna.

2. Related Art

Among portable electronic devices, there are folding-type devices configured from a first body and a second body that are configured to be able to be in an open state or in a close state via a hinge portion depending on the usage mode. Such a folding-type portable electronic device has a communication function of performing communication externally via an antenna.

For example, a technique has been disclosed, according to Patent Document 1, of changing the position of the ground of an antenna matching circuit depending on the open-close state of the first body and the second body.

By adaptively changing the position of the ground, the technique of Patent Document 1 makes the antenna current distribution favorable and does not allow the antenna characteristic to degrade.

In addition, a technique has been proposed that is able to achieve an improvement in antenna characteristic of portable electronic devices by disposing a reflector in the vicinity of the antenna.

Patent Document 1: Japanese Unexamined Patent Application Publication No. 2009-44224

SUMMARY OF THE INVENTION

Incidentally, the orientation direction of the antenna is fixed in portable electronic devices. Therefore, the characteristic of the antenna may degrade when a conductive material is disposed to a side in this orientation direction, for example.

The present invention has an object of providing a portable electronic device capable of reducing the degradation in the characteristic of an antenna caused by the orientation direction of the antenna being fixed.

In order to solve the above-mentioned problem, a portable electronic device according to the present invention includes: an operation unit; an antenna; a circuit board disposed in a vicinity of the antenna; an operation detection unit having conductivity that is provided to the circuit board and detects an operation to the operation unit; a reference potential part provided to the circuit board to be opposite to the operation detection unit; a conductive part provided to the circuit board to be opposite to the antenna; and a switch unit capable of switching whether the reference potential part and the conductive part are electrically connected.

In addition, in the portable electronic device, the switch unit may have a movable member that moves from a first position not abutting both the reference potential part and the conductive part to a second position abutting the reference potential part and the conductive part, accompanying a pressing operation on the operation unit.

Moreover, the portable electronic device may further include a control unit that switches whether the reference potential part and the conductive part are electrically connected by way of the switch unit, in a case of a predetermined condition being satisfied.

Additionally, in the portable electronic device, the conductive part may be provided at a position on the circuit board opposing the operation detection unit, and an isolating part that isolates a signal of a resonance frequency band of the antenna may be provided between the reference potential part and the conductive part.

Furthermore, in the portable electronic device, respective shapes of the antenna and the conductive part respectively may be substantially the same in an opposing direction of the antenna.

In addition, in the portable electronic device, the conductive part may be disposed to be opposite to the antenna with a gap of a length one fourth a wavelength corresponding to the resonance frequency band of the antenna.

Moreover, in the portable electronic device, the conductive part may have a first portion and a second portion that are not electrically connected to each other, and the switch unit may be configured to be able to switch whether the reference potential part is electrically connected with the first portion or the second portion.

Additionally, in the portable electronic device, the movable member may elastically deform accompanying a pressing operation on the operation unit and move to the second position in an elastically deformed state.

According to the present invention, it is possible to reduce the degradation of the characteristic of an antenna caused by the orientation direction of the antenna being fixed.

DETAILED DESCRIPTION OF THE INVENTION

Figure 1:
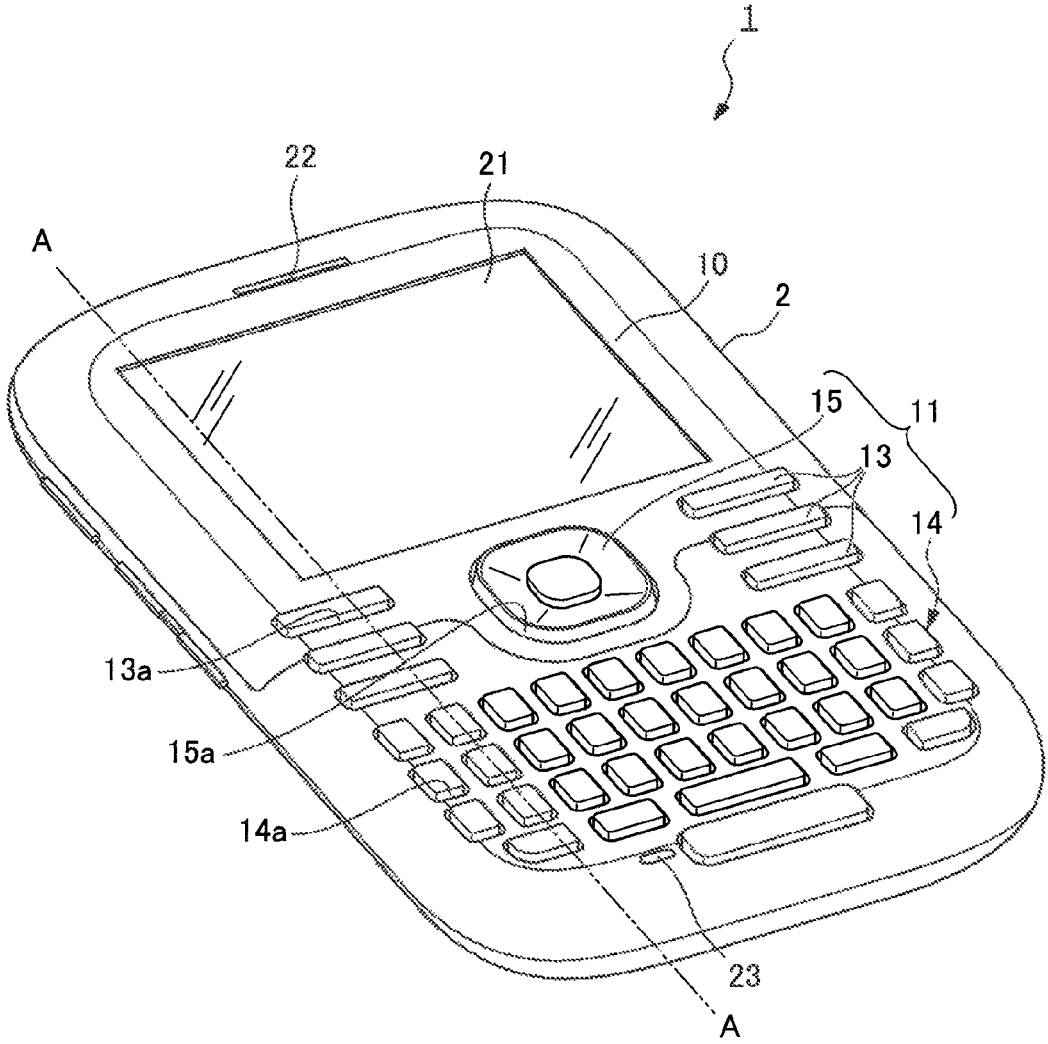
FIG. 1 is a perspective view of an external appearance of a cellular telephone according to an embodiment of a portable electronic device.

Hereinafter, a preferred embodiment for carrying out the present invention will be explained while referring to the drawings. First, the basic structure of a cellular telephone 1 according to an embodiment of the portable electronic device of the present invention will be explained while referring to FIG. 1. FIG. 1 is a perspective view of an external appearance of the cellular telephone 1 according to the embodiment of the portable electronic device.

As shown in FIG. 1, the cellular telephone 1 includes a body 2, as well as including an operation unit 11, a display unit 21, a speaker 22, and a microphone 23 disposed on a front surface 10 of this body 2.

The operation unit 11 is an operation target to which operations are made by a user. The display unit 21 is a device for displaying a variety of information such as textual information and image information. The speaker 22 is a device for outputting sounds of the other party of a telephone call. The microphone 23 is a device for inputting the sounds generated during a telephone call by the user of the cellular telephone 1.

Figure 2:
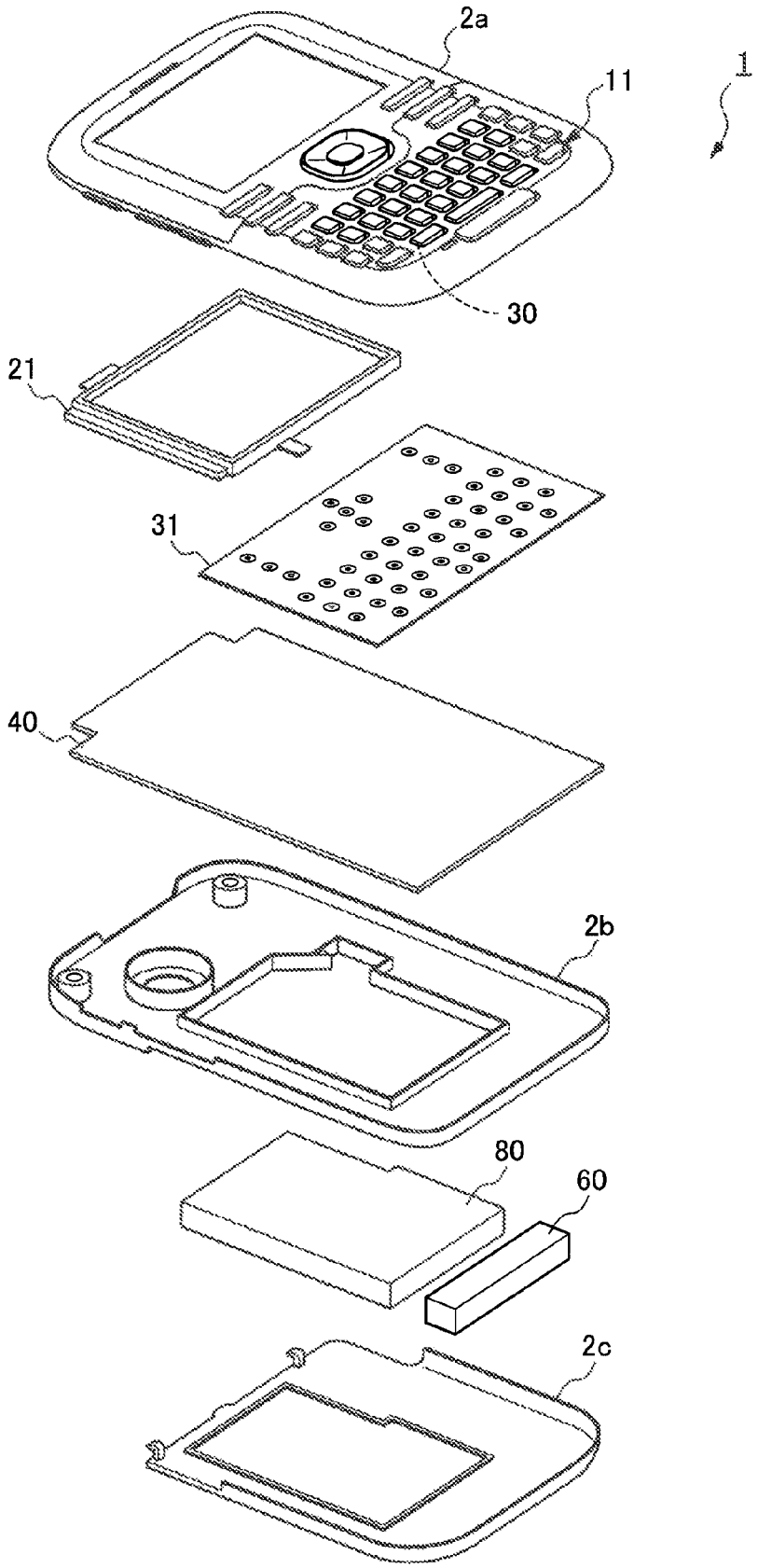
FIG. 2 is an exploded perspective view of the cellular telephone.
Figure 3:
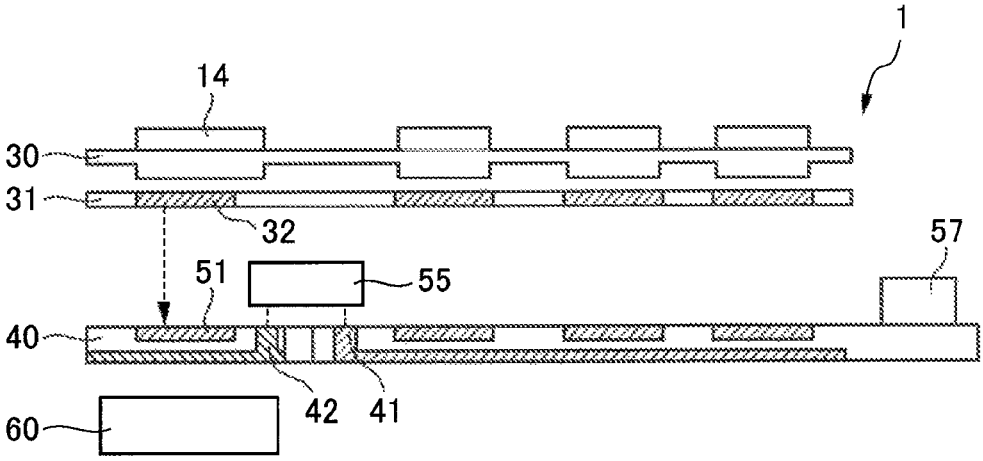
FIG. 3 is a view showing a configuration of the cellular telephone.

Next, the internal configuration of the cellular telephone 1 will be explained while referring to FIGS. 2 and 3. FIG. 2 is an exploded perspective view of the cellular telephone 1. FIG. 3 is a cross-sectional view schematically showing a cross section when the cellular telephone 1 shown in FIG. 1 is sectioned along the A-A line.

The cellular telephone 1 includes a front case 2*a*, a rear case 2*b*, and a battery lid 2*c*. The front case 2*a* and the rear case 2*b* are disposed so as that the internal surfaces of concave shape face each other, and are joined by making the outer peripheral edges thereof overlap each other. In addition, the battery lid 2*c* is detachably joined to the rear case 2*b* at an outer surface of the rear case 2*b*. Furthermore, with the cellular telephone 1, the display unit 21, the operation unit 11 including a key sheet 30, a metal dome sheet 31, a circuit board 40, an antenna 60, and a battery 80 are disposed between the front case 2*a* and the rear case 2*b*. The display unit 21, the operation unit 11, the metal dome sheet 31, the circuit board 40, the antenna 60, and the battery 80 are provided inside the body 2 to be collectively supported to each other in the thickness direction of the body 2 (direction to the interior side of the body 2 or direction to the exterior side of the body 2), as well as being sandwiched by the front case 2*a* and the rear case 2*b*.

The display unit 21 is configured from a liquid crystal display, organic EL (electroluminescence) display, or the like, for example.

The operation unit 11 is an operation target configured from key tops 13, 14 and 15, and the key sheet 30. The key tops 13, 14 and 15 are resin formed in rectangular shapes. The key tops 13, 14 and 15 are externally exposed through penetrating holes 13*a*, 14*a* and 15*a* (opening portions) formed in the front case 2*a*. When pressed to the interior side of the body 2 by a user, the key tops 13, 14 and 15 are pushed into the interior side of the body 2 by this pressing force. It should be noted that pressing of the key tops 13, 14 or 15 to the interior side of the body 2 by a user is hereinafter abbreviatedly explained as "operation".

The key sheet 30 is a member of sheet shape that is formed from a rubber having flexibility. The key tops 13, 14 and 15 are provided to a surface of the key sheet 30 on an external side of the body 2. In addition, plungers projecting to the interior side of the body 2 are formed on a surface of the key sheet 30 on an interior side of the body 2 to correspond to the key tops 13, 14 and 15.

Therefore, when an operation is made by the user, the plunger of the key sheet 30 will be pushed into the interior side of the body 2 along with the key top 13, 14 or 15.

On the other hand, when the operation has ended and the pressing force on the key top 13, 14 or 15 to the interior side of the body 2 decreases, the key top 13, 14 or 15 is pushed back to the exterior side of the body 2 by way of the resiliency of the rubber having flexibility, and the key sheet 30 returns to a state prior to the operation along with the key top 13, 14 or 15.

The metal dome sheet 31 is a member of film form that is flexible. The same number of metal domes 32 as the number of key tops 13, 14 and 15 are provided to the metal dome sheet 31 on a surface thereof on an exterior side of the body 2. The metal dome sheet 31 is pushed into the interior side of the body 2 by being pressed at the key top 13, 14 or 15 pushed into the interior side of the body 2 according to an operation of the user. In addition, when the operation has ended and the pressing force on the key top 13, 14 or 15 to the interior side of the body 2 decreases, the key top 13, 14 or 15 is pushed back to the exterior side of the body 2 by way of the resilience of the rubber having flexibility, and the metal dome sheet 31 returns to the state prior to the operation along with the key top 13, 14 or 15 and the key sheet 30.

The metal dome 32 is a convex-shaped hollow piece of metal having conductivity, the convex surface being configured to face the exterior side of the body 2. In addition, the metal dome 32 is provided to the metal dome sheet 31 so as to oppose the plungers of the key sheet 30. Then, when a plunger of the key sheet 30 is pushed into the interior side of the body 2 along with the key top 13, 14 or 15 of the body 2 according to the operation of the user, the convex surface elastically deforms by being collapsed in the hollow area by the plunger.

On the other hand, when the operation of the user ends, the pressing force on the key top 13, 14 or 15 to the interior side of the body 2 decreases, and as mentioned above, the plunger of the key sheet 30 is pushed back to the exterior side of the body 2; therefore, the collapsing is released and the convex surface of the metal dome 32 returns to the state prior to deformation by way of the elastic force.

It is possible for the user to get a click feeling through the elastic deformation of the metal dome 32 accompanying this operation. In other words, it is possible for the user to preferably feel the fact that the key top 13, 14 or 15 has been pushed down.

The circuit board 40 is a rigid substrate on which many electronic components are mounted, including a control unit 57 that is connected to various electronic components and manages a wide variety of controls using these electronic components. The electronic components mounted on the circuit board 40 are electrically connected to each other through a conductive circuit pattern. The mounted electronic components perform transfer of signals with each other through the circuit pattern.

In addition, switch terminals 51 (operation detecting units) are provided in the circuit board 40 at positions opposing the inner face of the convex surface of the metal domes 32. The switch terminals 51 are conductive patterns configuring a portion of the circuit pattern provided in the circuit board 40, and include a conductive outer-peripheral portion formed in a hollow circular shape and a conductive inner-peripheral portion formed in a circular shape in the hollow area of the first portion. The outer-peripheral portion and the inner-peripheral portion are provided in the circuit board 40 so as not to contact each other. Therefore, the outer-peripheral portion and the inner-peripheral portion are in a non-conducting relationship with each other.

However, the outer-peripheral portion and the inner-peripheral portion are provided in the circuit board 40 at positions abutting the inner face of the convex surface of the metal domes 32 that have been elastically deformed accompanying an operation by the user. Therefore, in a case of being operated by the user, the outer-peripheral portion and the inner-peripheral portion come to conduct with each other by way of the metal dome 32 that has been deformed. In other words, the outer-peripheral portion and the inner-peripheral portion enter a non-conducting state in a state in which an operation is not being made by the user, and enter a conducting state when an operation is made by the user. Specifically, the electrical state of the switch terminal 51 changes according to the existence of an operation by the user.

The switch terminal 51 is connected to the control unit 57 by the conductive circuit pattern formed on the circuit board 40. The control unit 57 receives an electrical state change of the switch terminal 51 as a signal, and determines the existence of an operation by the user and the content thereof based on this received signal.

By configuring in this way, the metal domes 32, the switch terminals 51 and the circuit pattern connecting switch terminals 51 and control unit 57 are made to function as a conductive operation detecting unit that detects operations.

In addition, a reference potential part 41 (ground pattern) configuring a portion of the circuit pattern is formed in the circuit board 40. The reference potential part 41 is a ground for achieving isolation between the metal domes 32, the switch terminals 51, and the circuit pattern connecting the switch terminals 51 and the control unit 57 from the antenna 60. The reference potential part 41 has an object of raising the isolation effect, and is provided in the circuit board 40 to oppose the metal domes 32, the switch terminals 51, and the circuit pattern connecting the switch terminals 51 and the control unit 57. In addition, a portion of the reference potential part 41 is exposed at a top surface of the circuit board 40 on an exterior side of the body 2 via a through hole formed in the circuit board 40.

The antenna 60 is an antenna element that resonates in a high-frequency signal. In the present embodiment, the antenna 60 is configured so as to resonate in a high-frequency signal in the 800 MHz band for executing a telephone function and a mail function. The antenna 60 is connected to a power feed point and, via the circuit pattern of the circuit board 40, to the control unit 57. The control unit 57 performs modulation or demodulation processing on signals in the 800 MHz band resonated in the antenna 60 to execute the telephone function and mail function.

The battery 80 is the power supply providing electric power to the electronic components mounted on the circuit board 40 and the like, and is made to be configured by a lithium-ion battery or the like, for example.

In this way, the cellular telephone 1 exhibits functions of a cellular telephone, allowing a user to perform operations via the operation unit 11, visually confirm a variety of information via the display unit 21, and employ the antenna 60 to use the telephone function and mail function.

Furthermore, in addition to the aforementioned configuration, the cellular telephone 1 includes a new configuration for controlling the directionality of the antenna 60.

Hereinafter, a configuration for controlling the directionality of the antenna 60 will be explained.

As shown in FIGS. 3 and 4, the cellular telephone 1 further has a conductive part 42 and a switch unit 55 on the circuit board 40.

The conductive part 42 constitutes a portion of the circuit pattern of the circuit board 40, and is provided at a position opposing the antenna 60. In addition, the conductive part 42 is formed, to be adjacent to the reference potential part 41 formed on the top surface of the circuit board 40 on the external side of the body 2 via a through hole, on the same top surface of the circuit board 40.

Figure 4A:
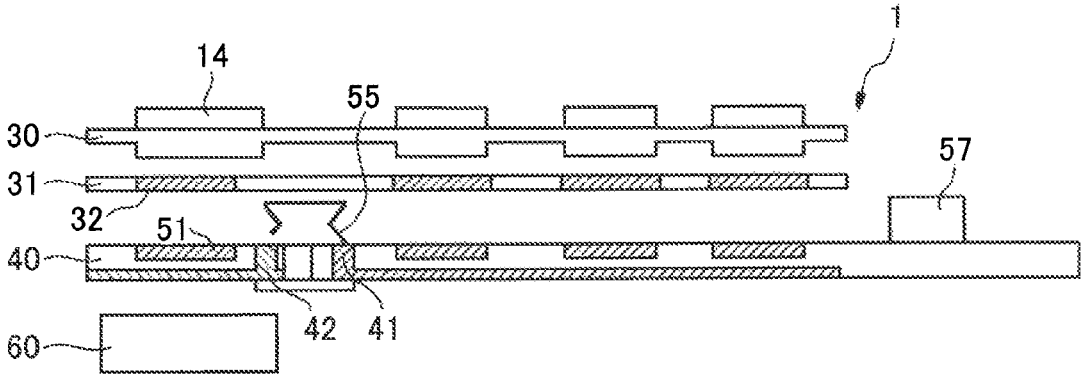
FIG. 4A is a view illustrating an internal state prior to a key being pressed.

The switch unit 55 is a conductive, thin plate member disposed between the circuit board 40 and the metal dome sheet 31. One end of the switch unit 55 is fixed by a well-known fixing means such as solder on the reference potential part 41 formed on the top surface of the circuit board 40 on the exterior side of the body 2 via the through hole (FIG. 4A). The other end of the switch unit 55 is disposed to be separated by a predetermined distance between the circuit board 40 and the metal dome sheet 31 at a position opposing the conductive part 42.

In addition, the switch unit 55 is provided in a shape bent several times from the one end to the other end such that an elastic force acts about the one end in the thickness direction of the body 2.

Figure 4B:
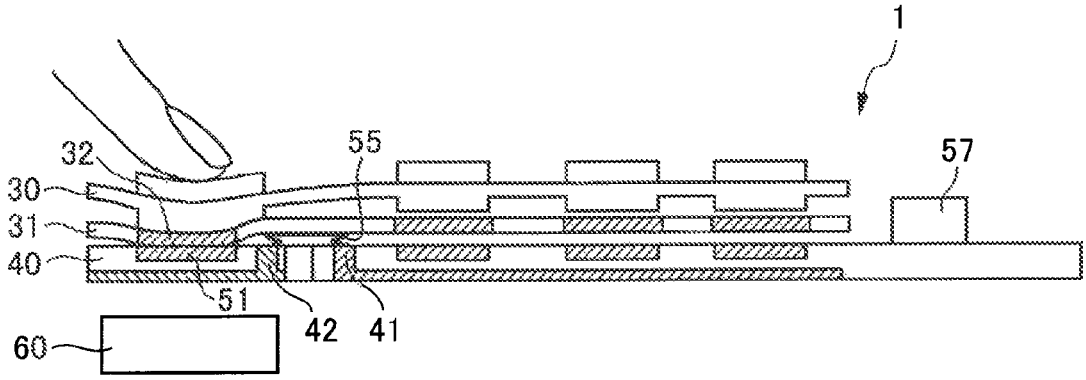
FIG. 4B is a view illustrating an internal state after a key being pressed.

Then, when the metal dome sheet 31 is pushed into the interior side of the body 2 accompanying an operation of the user, the other end of the switch unit 55 is pushed to the interior side of the body 2 by the metal dome sheet 31, and is pushed into the interior side of the body 2 to a position abutting the conductive part 42 (FIG. 4B).

On the other hand, when the operation of the user has ended and the metal dome sheet 31 returns to the state prior to the operation, the other end returns to the position prior to the operation by way of the elastic force attributed to the bent shape, about the one end of the switch unit 55.

Therefore, the switch unit 55 is configured to be movable from a first position abutting the reference potential part 41 but not abutting the conductive part 42, to a second position abutting both the reference potential part 41 and the conductive part 42, depending on the existence of an operation by the user. In other words, the switch unit 55 is configured to be able to switch whether or not the reference potential part 41 and the conductive part 42 are electrically connected.

According to the above configuration, when an operation is performed by the user, the conductive part 42 electrically connects with the reference potential part 41 by way of the switch unit 55 and becomes the same electrical potential (ground), and in a state in which an operation is not being performed, it is no longer electrically connected with the reference potential part 41, and enters a state isolated from the reference potential part 41.

In addition, accompanying a change in the electrical connection state between the reference potential part 41 and the conductive part 42, the ground area in a region opposing the antenna 60 also changes. Specifically, in a state in which an operation is being performed by the user, the conductive part 42 becomes grounded, a result of which the ground area in the region opposing the antenna 60 is the area obtained from the sum of the area of the reference potential part 41 and the area of the conductive part 42. In contrast, in a state in which an operation is not being performed by the user, since the conductive part 42 is in a state isolated from the reference potential part 42, the ground area in the region opposing the antenna 60 is an area equal to the area of the reference potential part 41.

Therefore, the ground area in the region opposing the antenna 60 changes in response to the existence of an operation, whereby the directions of radiation (transmission) and absorption (reception) of the radio waves resonating in the antenna 60 are changed to match by the ground. In the case of the present embodiment, the conductive part 42 is grounded and opposes the front case 2*a* side of the antenna 60 in a state in which an operation is being made. Consequently, the radio waves from the antenna 60 are emitted to the rear case 2*b* side by the conductive part 42.

On the other hand, the conductive part 42 enters a state isolated from the reference potential part 41 in a state in which an operation is not being made; therefore, there is no longer a ground hindering emission to the front case 2*a* side of the antenna 60. Therefore, the radio waves from the antenna 60 are emitted to the front case 2*a* side more than in a state in which an operation is being made.

By configuring in this way, the characteristic of the antenna 60 is adjusted according to the operation of the user on the operation unit 11. As a result, the directionality of the antenna 60 is easily adjusted even in a case in which degradation of the characteristic of the antenna 60 may occur from a conductive material or the like being disposed on the orientation direction side of the antenna, for example, and thus degradation of antenna characteristic is mitigated.

In addition, when simply performing operations on the operation unit 11 without pointing the orientation of the body in various orientations as is conventionally, the directionality of the antenna 60 in the cellular telephone 1 is controlled, and thus the characteristic of the antenna 60 is suitably maintained. In addition, if an operation unit for directionality adjustment of the antenna 60 is provided to the operation unit 11, the directionality of the antenna 60 will be adjusted more easily.

Figure 5:
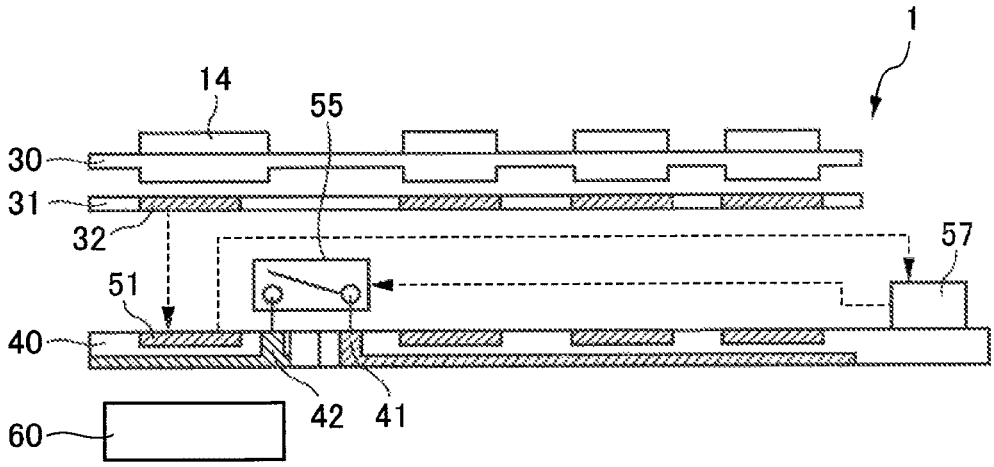
FIG. 5 is a view illustrating operations of the cellular telephone in a case of a switch part being configured by a mechanical switch.

Herein, as shown in FIG. 5, the cellular telephone 1 may be a configuration that switches whether or not the reference potential part 41 and the conductive part 42 are electrically connected by the switch unit 55, which is an electrical switch, according to the control unit 57, in a case of a predetermined condition having been satisfied.

In addition, the predetermined condition refers to a case in which an operation to the key top 13, 14 or 15 has been detected, or a case in which it has been detected that the cellular telephone 1 has been placed on a placement surface such as a desk. It should be noted that, although physical pressing operations to the key tops 13, 14 and 15 are detected in the present embodiment, it is not limited thereto, and a touch operation may be detected in a case of the operation unit 11 being configured in a touch panel format.

The control unit 57 controls the switch unit 55 so that the reference potential part 41 and the conductive part 42 are electrically connected in a case in which the cellular telephone 1 having been placed on a placement surface is detected or a case in which an operation to the key top 13, 14, or 15 is detected by a metal dome 32 and switch terminal 51. Herein, as the method of detecting whether the cellular telephone 1 has been placed on a placement surface, a method can be exemplified in which a light detecting unit that detects the light intensity at a predetermined location of the rear case 2*b* is provided, and the control unit 57 determines that the cellular telephone 1 has been placed on a placement surface in a case of the value detected by the light detecting unit falling below a predetermined value, for example.

Herein, a type of mobile terminal having an operation unit configured according to a key layout such as that of a personal computer (qwerty key layout) has been disclosed.

For such an operation unit configured according to the qwerty key layout, the number of keys increases drastically compared to an operation unit configured according to a ten-key layout, and a relatively wide space is required since the operability also needs to be ensured.

On the other hand, with a conventional mobile terminal 100, in order to obtain an adequate antenna characteristic, it has been configured such that a ground part 102 is not disposed in a region in which an antenna 101 is disposed.

Figure 6A:
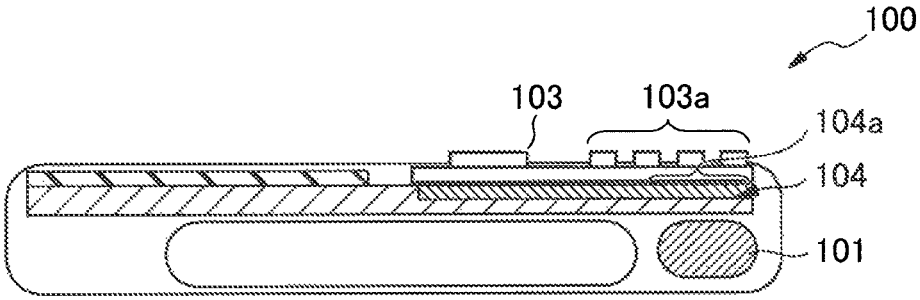
FIG. 6A is a cross-sectional view showing the configuration of a conventional mobile terminal.
Figure 6B:
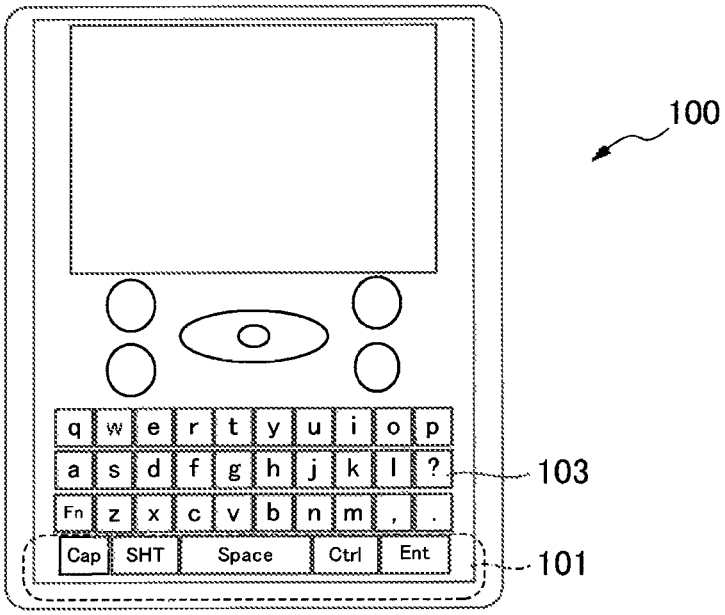
FIG. 6B is a view showing the configuration of a conventional mobile terminal.

However, in a mobile terminal in which an operation unit 103 is configured according to the qwerty key layout, a portion of the operation unit 103 and the antenna 101 may overlap in the thickness direction of the body due to the demand for miniaturization and lower profiles, for example (refer to FIGS. 6A and 6B).

In addition, since a circuit board 104 is disposed below the operation unit 103, a portion 104*a* of the circuit board 104 and the antenna 101 overlap in the thickness direction of the body as a result (refer to FIGS. 6A and 6B).

Figure 7:
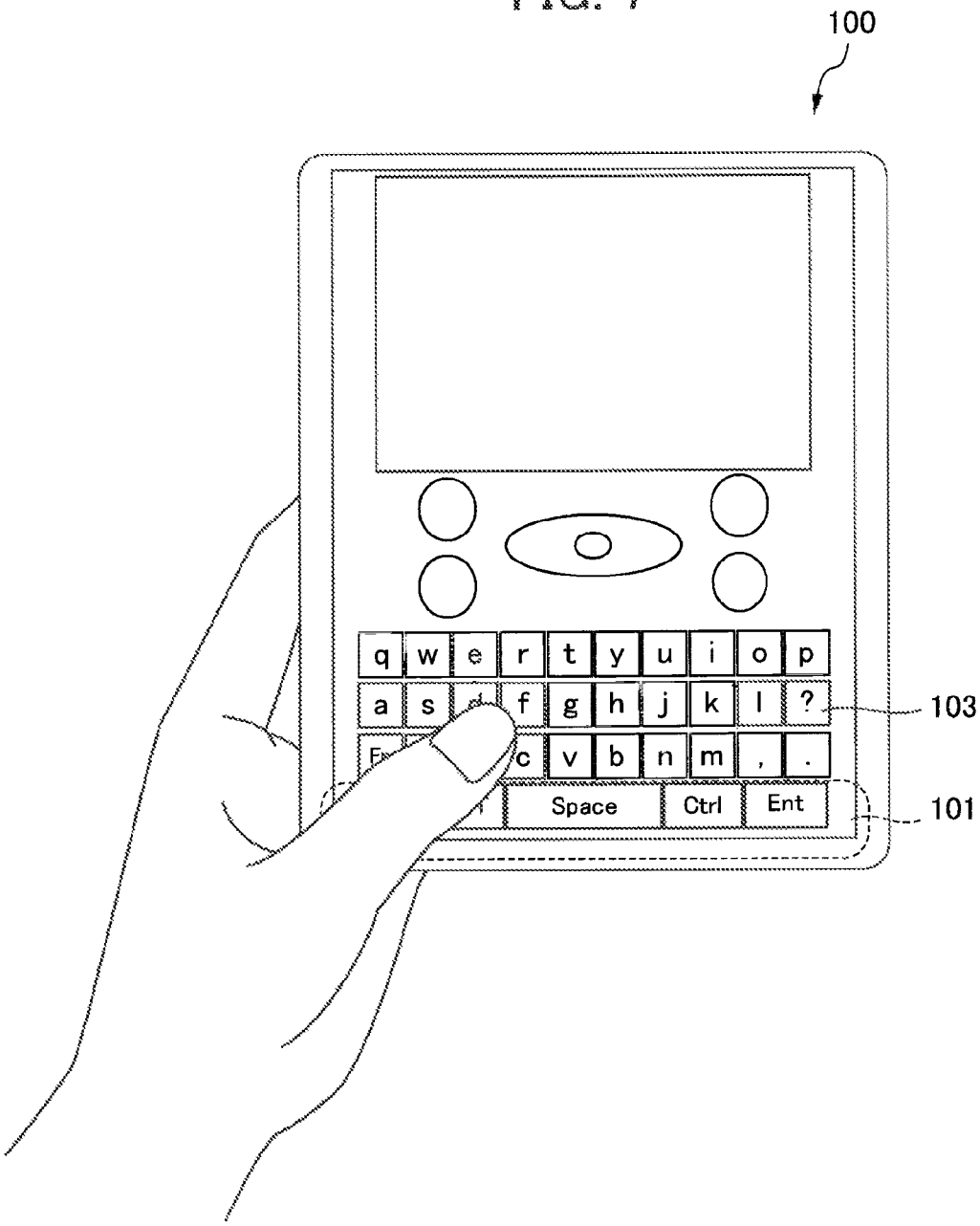
FIG. 7 is a view showing an appearance of a portable electronic device being covered by the hand of a user.

In addition, in a case of a portion 103*a* of the operation unit 103 and the antenna 101 overlapping in the thickness direction of the body in this way, the user will shield at least a portion of the antenna 101 with their hand when operating the keys (qwerty keys) of the operation unit 103 (refer to FIG. 7). In such a case, the radio waves transmitted and received by the antenna 101 are absorbed by the hands of the user, whereby the characteristic of the antenna 101 degrades.

Figure 8A:
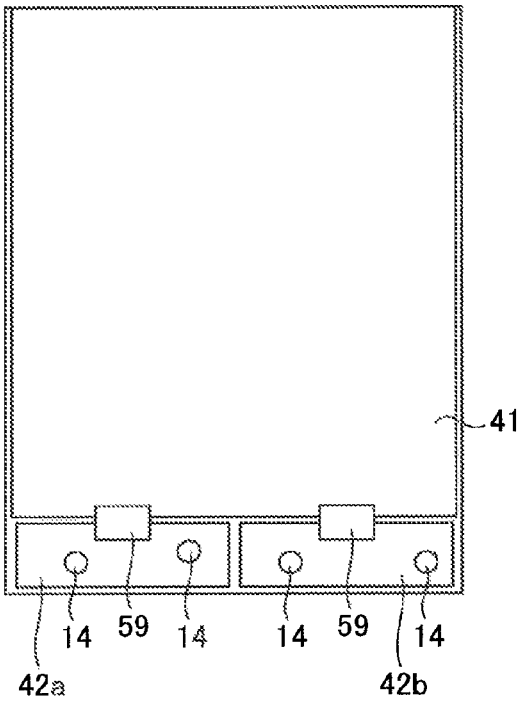
FIG. 8A is a view illustrating operations of a cellular telephone in a case of a reference potential part and a conductive part being connected by an isolating part.
Figure 8B:
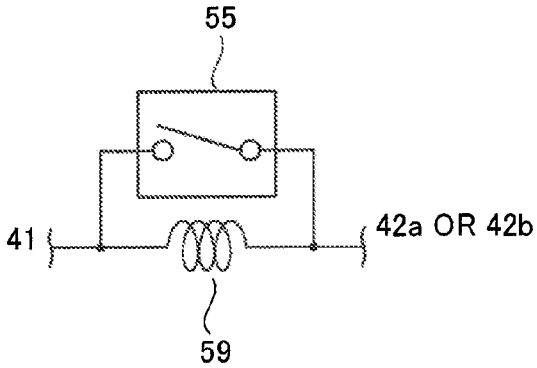
FIG. 8B is a view illustrating operations of a cellular telephone in a case of a reference potential part and a conductive part being connected by an isolating part.
Figure 9:
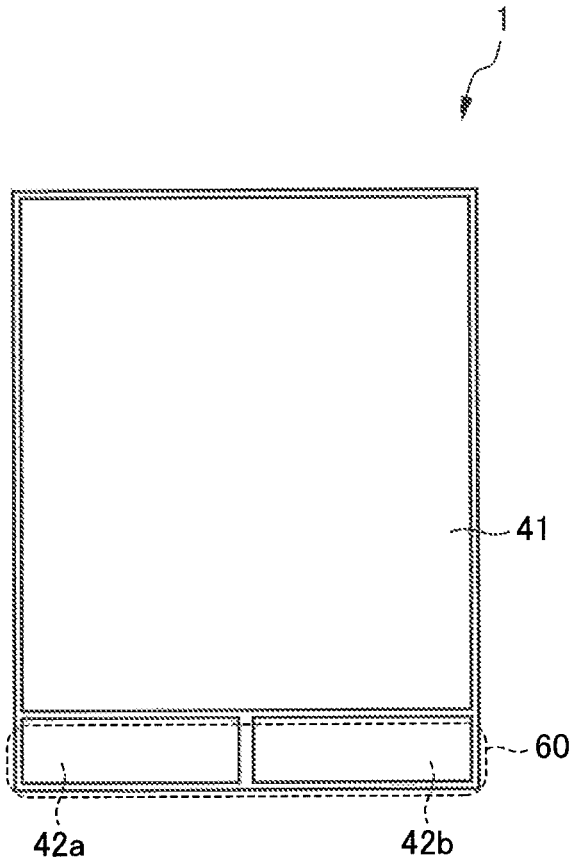
FIG. 9 is a view showing an appearance of the conductive part configured from a first portion and a second portion.

Therefore, the conductive part 42 in the cellular telephone 1 of the present embodiment is provided at positions opposing the metal domes 32 and the signal wires, which are not illustrated, provided to the circuit board 40, as shown in FIGS. 8A, 8B and 9. In addition, the conductive part 42 has a first portion 42*a* and a second portion 42*b* that are not electrically connected to each other. The switch unit 55 is configured to be able to switch whether the reference potential part 41 and the first portion 42*a* or second portion 42*b* are electrically connected.

Figure 10:
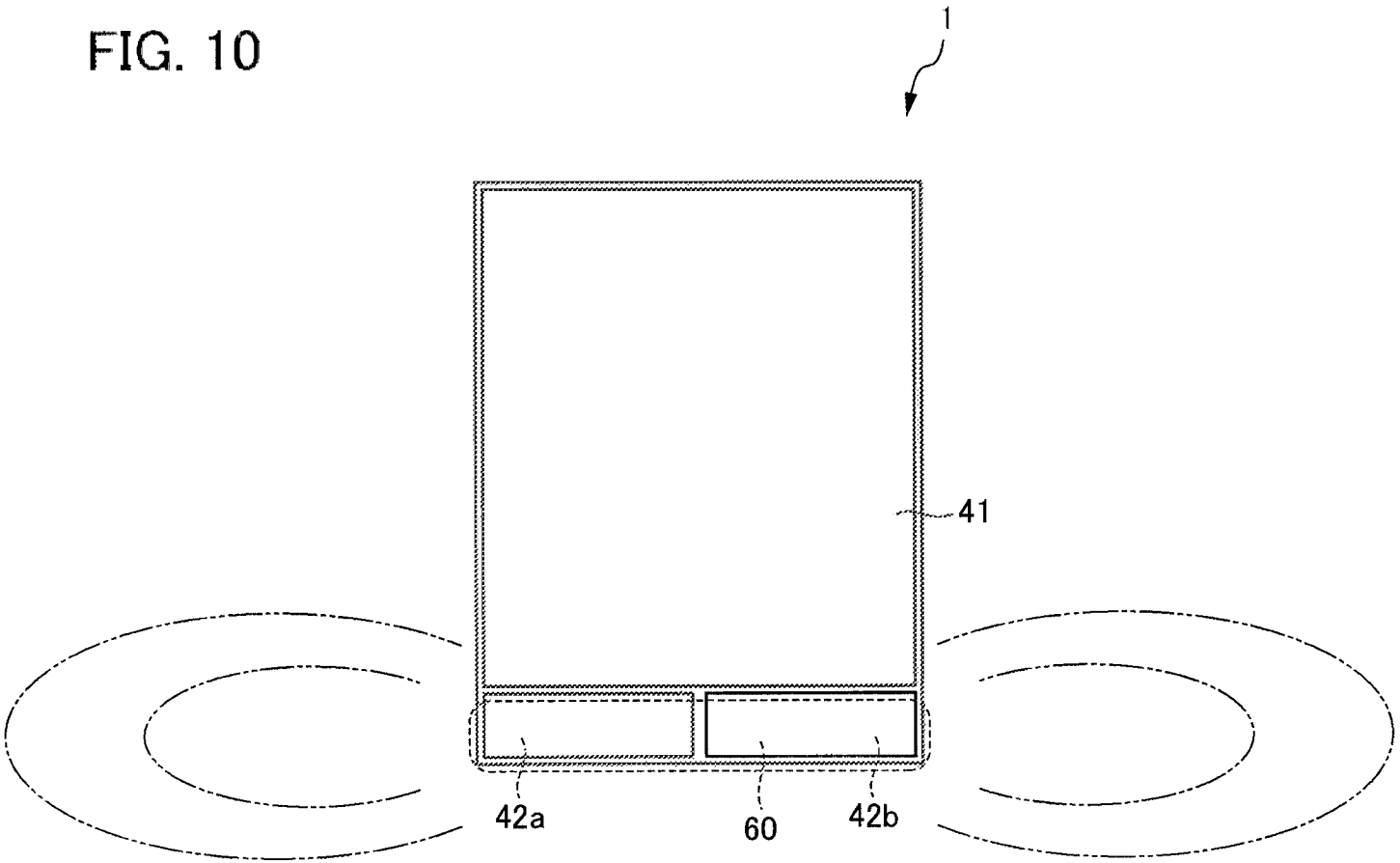
FIG. 10 is a view illustrating the directions of radiation (transmission) and absorption (reception) of radio waves by the antenna.

More specifically, the conductive part 42 is provided to positions overlapping with the antenna 60 in the thickness direction of the body, and has the first portion 42*a* positioned on the left side and the second portion 42*b* positioned on the right side in the width direction of the body, as shown in FIG. 9. The directions of radiation (transmission) and absorption (reception) of radio waves by the antenna 60 at this time spread in the width direction of the body, as schematically shown in FIG. 10.

Figure 11:
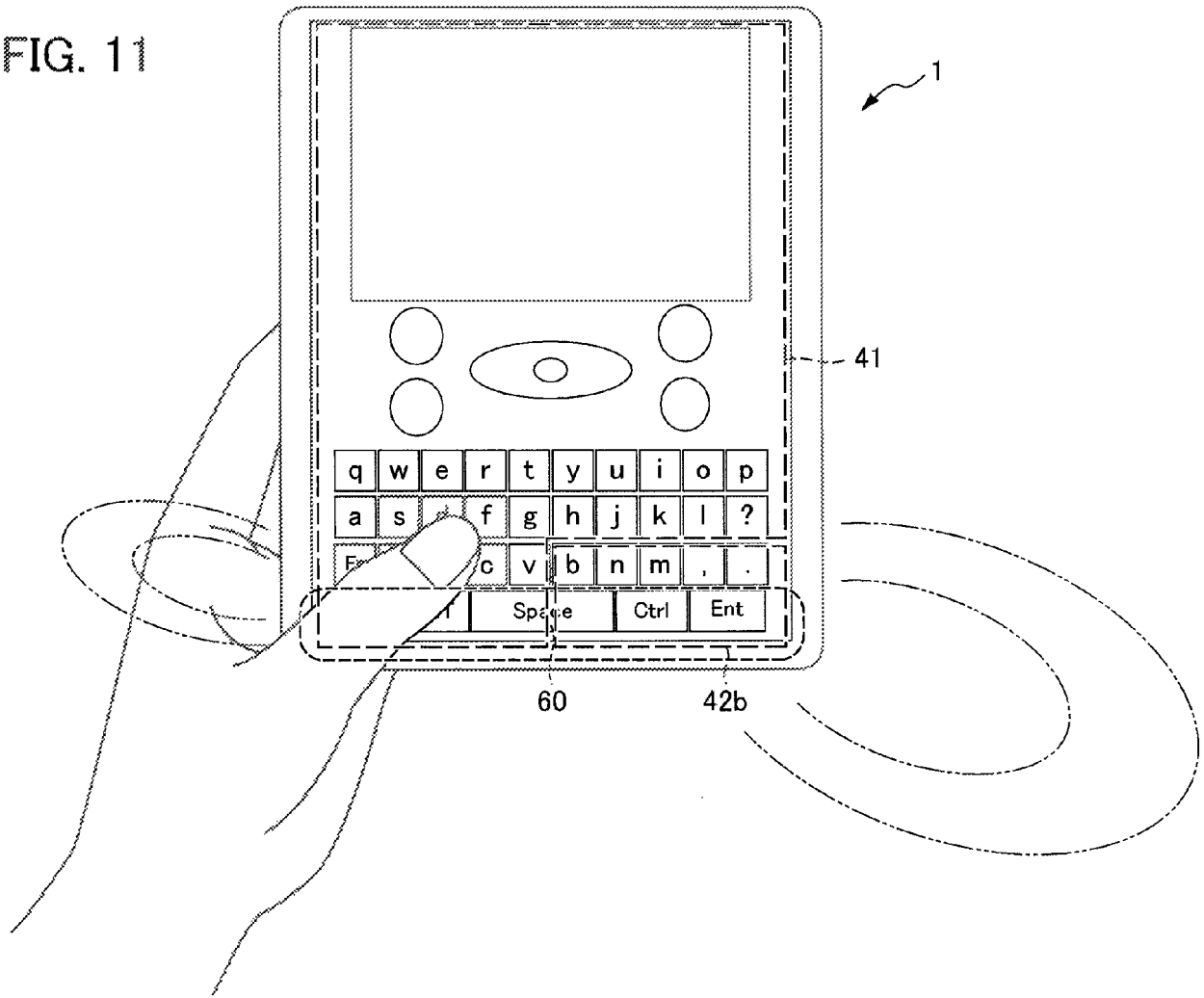
FIG. 11 is a view illustrating the directions of radiation (transmission) and absorption (reception) of radio waves by the antenna.

Herein, the first portion 42*a* and the reference potential part 41 are electrically conducting by way of the switch unit 55 in a case of a key disposed above the first portion 42*a* being pressed (e.g., "Cap" key, "Fn" key, or "z" key). In such a case, all but the second portion 42*b* is a ground part, and exhibits a function as a reflective plate (reflector); therefore, the directions of radiation (transmission) and absorption (reception) of radio waves by the antenna 60 spread more widely to the side on which the second portion 42*b* is disposed than the side on which the first portion 42*a* is disposed, as schematically shown in FIG. 11.

Figure 12:
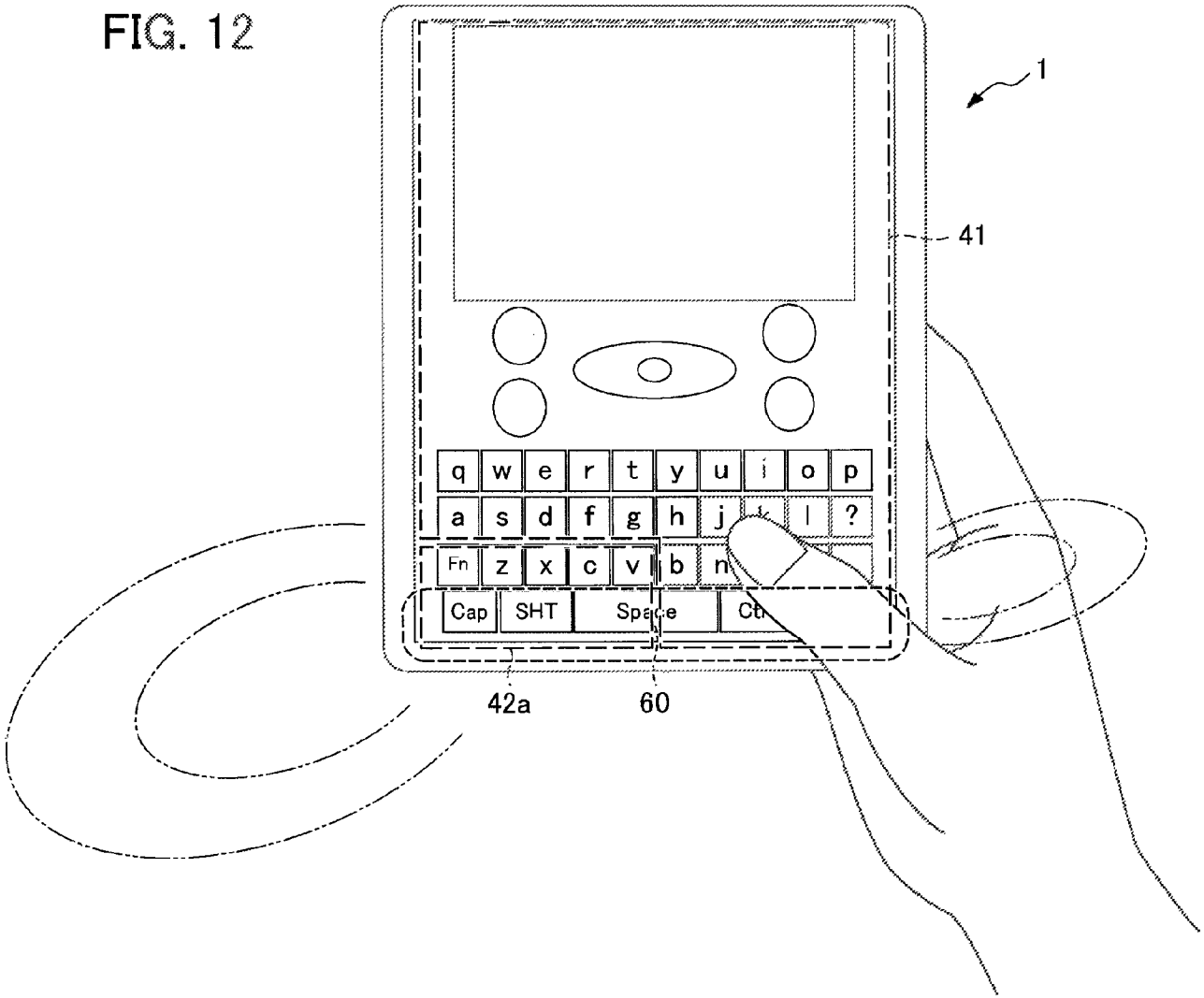
FIG. 12 is a view illustrating the directions of radiation (transmission) and absorption (reception) of radio waves by the antenna.

On the other hand, the second portion 42*b* and the reference potential part 41 are electrically conducting by way of the switch unit 55 in a case of a key disposed above the second portion 42*b* being pressed (e.g., "Ent" key, "Ctrl" key, or "m" key). In such a case, all but the first portion 42*a* is a ground part, and exhibits a function as a reflective plate (reflector); therefore, the directions of radiation (transmission) and absorption (reception) of radio waves by the antenna 60 spread more widely to the side on which the first portion 42*a* is disposed than the side on which the second portion 42*b* is disposed, as schematically shown in FIG. 12.

By configuring in this way, it is possible for cellular telephone 1 to change the radiation pattern of the antenna 60 according to the position of the key pressed.

Herein, the user pressing a key refers to the cellular telephone 1 being strongly pressed by hand; therefore, the cellular telephone 1 can reduce the influence of the human body and obtain a suitable antenna characteristic by controlling so that the directions of radiation (transmission) and absorption (reception) of radio waves by the antenna 60 are focused to a side not being pressed.

Figure 13:
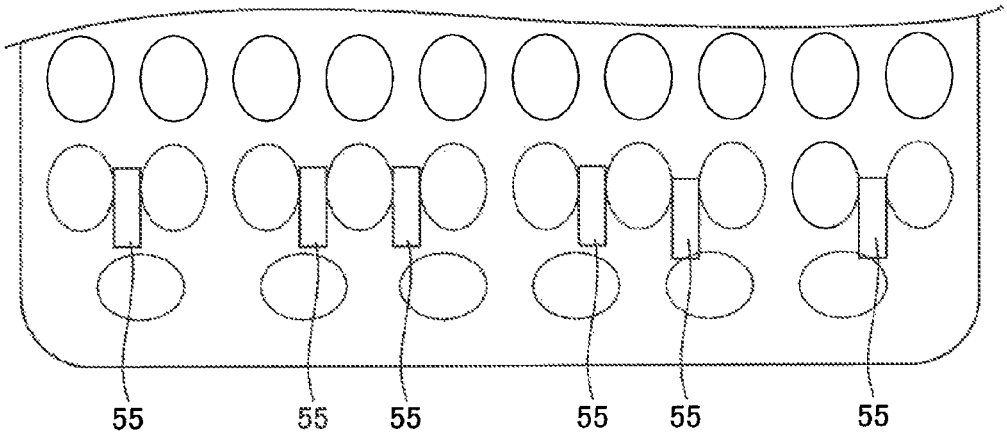
FIG. 13 is a view illustrating a state in which switch parts are disposed in plurality.

The method for causing the reference potential part 41 and the conductive part 42 to electrically conduct has been carried out using the switch unit 55 as mentioned above. Herein, switch units 55 may be disposed at a plurality of locations on the circuit board 40, as shown in FIG. 13. FIG. 13 schematically shows the appearance of the switch units 55 being disposed at the six locations of between the "Fn" key and "z" key, between the "x" key and "c" key, between the "c" key and "v" key, between the "b" key and "n" key, between the "n" key and "m" key, and between the "," key and "." key.

Figure 14:
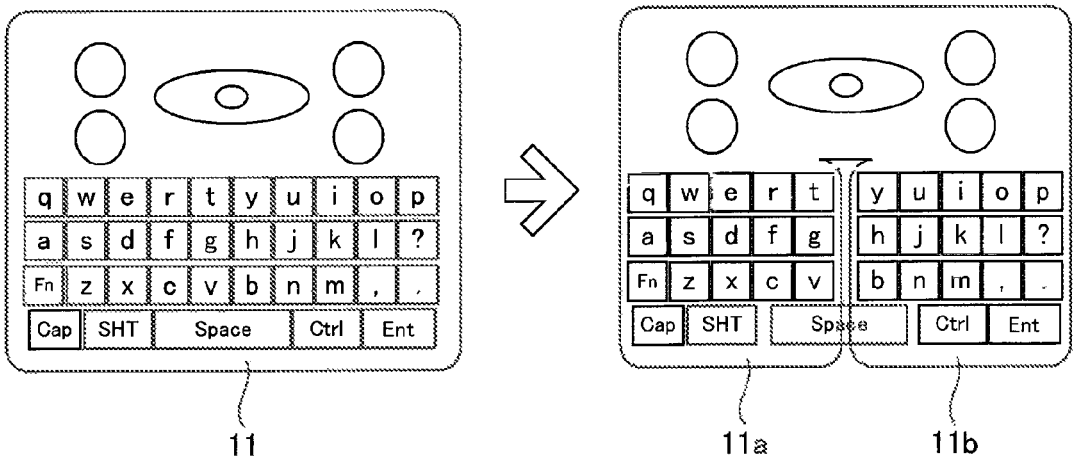
FIG. 14 is a view illustrating the state in which an operation unit is configured to be divided.

In addition, the cellular telephone 1 may be a configuration in which the operation unit 11 is divided into a left-side key group 11*a* gathered on the left side and a right-side key group 11*b* gathered on the right side, which are divided in the middle, as shown in FIG. 14. By configuring in this way, it is possible to suppress the switch unit 55 between the "b" key and "n" key from being pressed when the user presses the "v" key, for example. In addition, since the first portion 42*a* of the conductive part 42 is disposed below the left-side key group 11*a* and the second portion 42*b* of the conductive part 42 is disposed under the right-side key group 11*b*, the cellular telephone 1 can accurately cause the first portion 42*a* or second portion 42*b* to conduct with the reference potential part 41 according to the position of the key pressed.

It should be noted that, although the "Space" key is shown to straddle both the left-side key group 11*a* and the right-side key group 11*b* in FIG. 14, it is not limited thereto, and may be a configuration grouped on one side, divided at the center, grouped with the one on the left side, or grouped with the other one on the right side.

Herein, when the conductive part 42 is not electrically connected with the reference potential part 41, the metal domes 32 and signal wires (not illustrated) provided to the circuit board 40 may cause unwanted resonance with the radio waves transmitted and received by the antenna 60. In this situation, the cellular telephone 1 has an isolating part 59 that is provided between the reference potential part 41 and the conductive part 42, and isolates the signals of the resonance frequency band of the antenna 60, as shown in FIGS. 8A, and 8B. The isolating part 59 is configured by a coil or LC resonance circuit, and can isolate signals of the resonance frequency band (e.g., 800 MHz band) of the antenna 60.

In this case, the first portion 42*a* and the second portion 42*b* are in a state connected with the reference potential part 41 of the circuit board 40 by the isolating part 59 configured with the aforementioned coil or the like, in an initial state (e.g., state in which a key operation is not being made by the user, or state not being placed on a placement surface such as a desk). Since the isolating part 59, which is a high frequency isolating means, is provided between the reference potential part 41 and the conductive part 42, the reference potential part 41 and the conductive part 42 are in a direct-current shorted state and a high frequency open state.

In addition, with the cellular telephone 1 in such a configuration, since a switch unit 55 causes the reference potential part 41 and the conductive part 42 to electrically conduct when a predetermined key of the operation unit 11 is pressed by the user, the reference potential part 41 and the conductive part 42 are in a direct-current shorted state and a high frequency shorted state.

According to the above such configuration, it is possible to suppress the metal domes 32 and signal wires (not illustrated) provided to the circuit board 40 from causing unwanted resonance with the radio waves transmitted and received by the antenna 60.

In addition, in the cellular telephone 1, it is preferable for the shape of a first opposing face A of the antenna 60 opposing the conductive part 42 and the shape of a second opposing face B of the conductive part 42 opposing the antenna 60 to be substantially the same shape.

Figure 15:
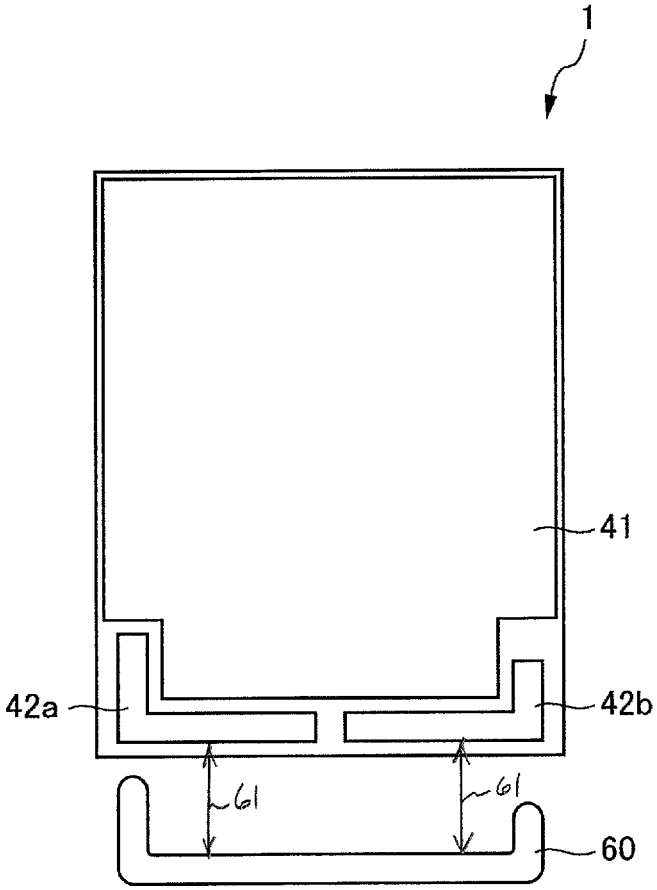
FIG. 15 is a view illustrating the aspect of the conductive part and antenna being made in the same shape.

FIG. 15 schematically shows an appearance of the shape of two independent conductive parts 42 (first portion 42*a* and second portion 42*b*) respectively made substantially the same as the shape of the corresponding antenna 60.

Herein, the shape of the first opposing face A and the shape of the second opposing face B being substantially the same refers to the shape of the antenna 60 and the shape of the conductive part 42 viewed from the thickness direction of the body 2 matching when the antenna 60 and conductive part 42 are opposing in the thickness direction, for example. It should be noted that both ends of the antenna 60 in FIG. 15 are arc shaped, and both ends of the first portion 42*a* and the second portion 42*b* of the conductive part 42 are straight; therefore, the shape of the antenna 60 and the shape of the conductive part 42 viewed from the thickness direction of the body 2 are not matching. However, in the case of this extent of difference in the shapes, they can be regarded as being substantially the same.

By configuring in this way, the antenna 60 and the conductive part 42 have been arranged to configure a waveguide by making the shapes of the first opposing face A and the second opposing face B substantially the same shape. Consequently, the directionality of the antenna 60 can be suitably controlled to perform communication via radio waves, and it is possible to improve the antenna characteristic.

In addition, it is preferable for the conductive part 42 (first portion 42*a* and second potion 42*b*) in the cellular telephone 1 to be disposed to oppose the antenna 60 with a space 61 of one quarter the length of the wavelength corresponding to the resonance frequency of the antenna 60 as shown in FIG. 15.

By being configured in this way, the directionality of the antenna 60 can be more suitably controlled to perform communication via radio waves, and it is possible to improve the antenna characteristic.

ALTERNATIVE EXAMPLES

In addition, the following examples are given as alternative examples.

A user generally performs operations of the cellular telephone 1 with their dominant arm. In addition, in a case of the user holding the cellular telephone 1 with their right hand, the right side of the cellular telephone 1 is covered, and in a case of the user holding the cellular telephone 1 with their left hand, the left side of the cellular telephone 1 is covered.

Therefore, in a case of setting the dominant arm of the user in advance, and the setting of the dominant arm as being left-handed, the cellular telephone 1 will electrically connect the left side of the conductive part 42 (first portion 42*a*) with the reference potential part 41, and in a case of the setting of the dominant arm as being right-handed, will electrically connect the right side of the conductive part 42 (second portion 42*b*) with the reference potential part 41. Then, in a case of a key having been operated, the cellular telephone 1 electrically conducts the reference potential part 41 with the first portion 42*a* or second portion 42*b* according to the position of the key operated.

By configuring in this way, the cellular telephone 1 can change the directions of radiation (transmission) and absorption (reception) of the radio waves from the antenna 60 according to the usage state of the user. It should be noted that the cellular telephone 1 may be a configuration that switches so as to enter a state in which the first portion 42*a* and the second portion 42*b* are not electrically connected with the reference potential part 41 when it has been detected to have been placed on a placement surface.

In addition, the cellular telephone 1 may be a configuration that causes the reference potential part 41 to be electrically conducting with the first portion 42*a* or second portion 42*b* according to the setting of the dominant arm, and subsequently, in a case of an application in which qwerty keys are used such as a notepad, maintains this state even if detecting to have been placed on a placement surface.

It should be noted that, although an example has been illustrated in the above description in which the conductive part 42 is divided into the two of the first portion 42*a* and the second portion 42*b*, it is not limited thereto, and may be configured to be divided into three or more. According to such a configuration, the cellular telephone 1 can diversely control the directions of radiation (transmission) and absorption (reception) of the radio waves from the antenna 60.

It should be noted that the cellular telephone 1 is not limited to the form shown in FIG. 1. For example, the cellular telephone 1 may be a cellular telephone of folding type including a display unit-side body having a display unit, an operation unit-side body having an operation unit, and a hinge portion that couples the display unit-side body and the operation unit-side body. In addition, the cellular telephone may be of slider type, which is configured so as to allow one body to slide in one direction from a state in which the operation unit-side body and the display unit-side body are superimposed, rotating type, which is configured so as to allow one body to rotate about an axis line along the superimposing direction, or may be one in which the operation unit-side body and the display unit-side body are connected via a two-axis hinge.

Furthermore, the switch unit 55 is not necessarily limited to the aforementioned configuration, so long as being movable from a position not abutting at least one of the reference potential part 41 and the conductive part 42 to a position abutting both the reference potential part 41 and the conductive part 42 in response to the existence of an operation. For example, the switch unit 55 may be fixed to the surface of the metal dome sheet 31 on the interior side of the body 2 from one end to the other end so as not to abut both the reference potential part 41 and the conductive part 42. Then, it may be configured to abut both the reference potential part 41 and the conductive part 42 in either region to switch the electrical connection state between the reference potential part 41 and the conductive part 42, when the metal dome sheet 31 has been pushed into the interior side of the body 2 by an operation of the user.

In addition, although the switch unit 55 itself is a movable member in the case of the switch unit 55 being configured by a mechanical switch in the above-mentioned embodiment, the present invention is not limited thereto, and the switch unit 55 may be configured to include a movable member and another member.

What is claimed is:

1. A portable electronic device comprising:

an operation unit;

an antenna;

a circuit board disposed in a vicinity of the antenna;

a reference potential part provided to the circuit board;

a conductive part provided to the circuit board to be opposite to the antenna;

an operation detection unit, wherein the conductive part is provided at a position on the circuit board opposing the operation detection unit;

an isolating part that isolates a signal of a resonant frequency band of the antenna is provided between the reference potential part and the conductive part;

and switch unit capable of switching whether the reference potential part and the conductive part are electrically connected.

2. The portable electronic device according to claim 1, wherein the switch unit is a movable member that moves from a first position not abutting at least one among the reference potential part and the conductive part to a second position abutting both the reference potential part and the conductive part, accompanying a pressing operation on the operation unit.

3. The portable electronic device according to claim 1, further comprising a control unit that switches whether the reference potential part and the conductive part are electrically connected by way of the switch unit, in response to a predetermined condition being satisfied.

4. The portable electronic device according to claim 1, wherein respective shapes of the antenna and the conductive part respectively are substantially the same in an opposing direction.

5. The portable electronic device according to claim 1, wherein the conductive part is disposed to oppose the antenna with a space of one quarter of a length of a wavelength therebetween, the wavelength corresponding to a resonant frequency band of the antenna.

6. The portable electronic device according to claim 1, wherein the conductive part includes a first portion and a second portion that are not electrically connected to each other, and wherein the switch unit is configured to be able to switch whether the reference potential part is electrically connected with the first portion or the second portion.

7. The portable electronic device according to claim 2, wherein the movable member elastically deforms accompanying a pressing operation on the operation unit and moves to the second position in an elastically deformed state.

* * * * *